US009314051B2

(12) United States Patent
Lin

(10) Patent No.: US 9,314,051 B2
(45) Date of Patent: Apr. 19, 2016

(54) SELF-CLEANING CIGARETTE TOBACCO COMPACTING MECHANISM

(75) Inventor: Mei Lin, Northbrook, IL (US)

(73) Assignee: REPUBLIC TOBACCO L.P., Glenview, IL (US)

( * ) Notice: Subject to any disclaimer, the term of this patent is extended or adjusted under 35 U.S.C. 154(b) by 1032 days.

(21) Appl. No.: 13/453,671

(22) Filed: Apr. 23, 2012

(65) Prior Publication Data

US 2013/0276800 A1 Oct. 24, 2013

(51) Int. Cl.
*A24C 5/40* (2006.01)
*A24C 5/42* (2006.01)

(52) U.S. Cl.
CPC .... *A24C 5/42* (2013.01); *A24C 5/40* (2013.01)

(58) Field of Classification Search
CPC ..... A24C 5/40; A24C 5/42
See application file for complete search history.

(56) References Cited

U.S. PATENT DOCUMENTS 2,314,734 A * 3/1943 Ptasnik ..... A24C 5/42 131/70
2,731,971 A 1/1956 Kastner
4,303,082 A * 12/1981 Thompson ..... A24C 5/42 131/70
2007/0044812 A1 3/2007 Juan
2012/0312311 A1 12/2012 Lin

FOREIGN PATENT DOCUMENTS

| | | | |
|---|---|---|---|
| CN | 202635591 | U | 1/2013 |
| GB | 139223 | A | 3/1921 |
| GB | 464948 | A | 4/1937 |
| GB | 1586625 | A | 3/1981 |
| PL | P.398407 | | 12/2012 |

OTHER PUBLICATIONS

International Search Report and Written Opinion issued in related application P403633 dated Jul. 5, 2013, 1 page.
International Search Report and Written Opinion issued in related application GB1307178.2 dated Oct. 17, 2013, 1 page.
Search report issued in corresponding French application No. FR 1353617, Jan. 16, 2015, 1 page.

* cited by examiner

*Primary Examiner* — Michael J Felton
(74) *Attorney, Agent, or Firm* — Michael Best & Friedrich LLP

(57) ABSTRACT

A self-cleaning cigarette tobacco compacting mechanism with a compacting member mounted for reciprocal up and down motion between top and bottom plates and a self-cleaning slot extending across one of the plates to engage at least one of the plates during its up and down motion between the plates.

11 Claims, 5 Drawing Sheets

SELF-CLEANING CIGARETTE TOBACCO COMPACTING MECHANISM

FIELD OF THE INVENTION

This invention pertains generally to cigarette-making machines and, more particularly, to self-cleaning tobacco compacting mechanisms for use in cigarette-making machines.

BACKGROUND OF THE INVENTION

Various types of manual, semi-automatic and automatic cigarette-making machines are known in which loose tobacco is compacted into a rod-like shape and transported into a hollow cigarette tube to prepare a cigarette. In many of these cigarette-making machines loose tobacco is first placed into a compacting apparatus including a compacting chamber in which a reciprocating compacting member engages and compresses the loose tobacco into the rod-like shape and then is withdrawn from the compacting chamber. This compressed tobacco rod-like shape is typically carried on an injection spoon which moves across the compacting chamber to transport the rod-like shape into a hollow cigarette tube positioned outside the cigarette-making machine and adjacent the chamber.

Cigarette tobacco naturally contains sugars and other natural components and may also contain liquid additives all of which are partially released as a gummy mixture when the tobacco is compressed as in a compacting mechanism. Compressing loose tobacco not only releases such gummy mixtures but it also breaks up some of the loose tobacco to produce tobacco fines. The tobacco fines as well as the gummy mixtures released during the compressing operation may present impediments to the efficient operation of the compacting apparatus.

Although problems are not likely to arise in the initial use of cigarette-making machines with compacting apparatuses as described above, after myriad loose tobacco loads are compressed and transported into cigarette tubes, the build-up of tobacco fines and gummy tobacco materials may impede the movement of the reciprocating compacting member. If this impediment to movement could be reduced or eliminated, the operation of cigarette-making machines using compacting apparatuses could be substantially improved.

It is therefore an object of the present invention to provide a structure for controlling the build up of tobacco fines and gummy tobacco materials during the operation of cigarette-making machines using compacting apparatuses.

BRIEF SUMMARY

Embodiments of the invention include a self-cleaning cigarette tobacco compacting mechanism having a compacting chamber for receiving loose tobacco. The compacting chamber is positioned between top an bottom plates and a compacting member is mounted for reciprocal up and down motion between the plates. The compacting member has a bottom face that moves opposite the bottom plate.

A self-cleaning slot extends across the bottom plate and is positioned to engage the bottom face of the compacting member during its reciprocal up and down motion between the plates. This up and down motion of the face of the compacting member against the slot will scrape away tobacco fines and gummy materials that may accumulate in the interstice between the compacting member and the plate.

The scraping action is accomplished most efficiently if the self-cleaning slot includes sharp edges that engage the bottom face of the compacting member. In an alternate embodiment, the edges of the self-cleaning slot may be serrated. Also, the self-cleaning slot may be angled with respect to the horizontal across the bottom plate.

In embodiments of the invention the self-cleaning slot may extend perpendicularly across the bottom plate between its back and front faces. Alternatively, the self-cleaning slot may be angled between the back and front faces of the back plate.

BRIEF DESCRIPTION OF THE DRAWINGS

In order to aid in understanding embodiments of the invention, it will now be described in connection with exemplary embodiments thereof with reference to the accompanying drawings in which like numerical designations will be given to like features.

DETAILED DESCRIPTION OF EXEMPLARY EMBODIMENTS

The embodiments described below are not intended to be exhaustive or to limit the invention to the precise structures and operation disclosed. Rather, the described embodiments have been chosen to explain principles of the invention and their application, and the operation and use of embodiments of the invention in order to best enable others skilled in the art to follow its teachings.

Figure 1:
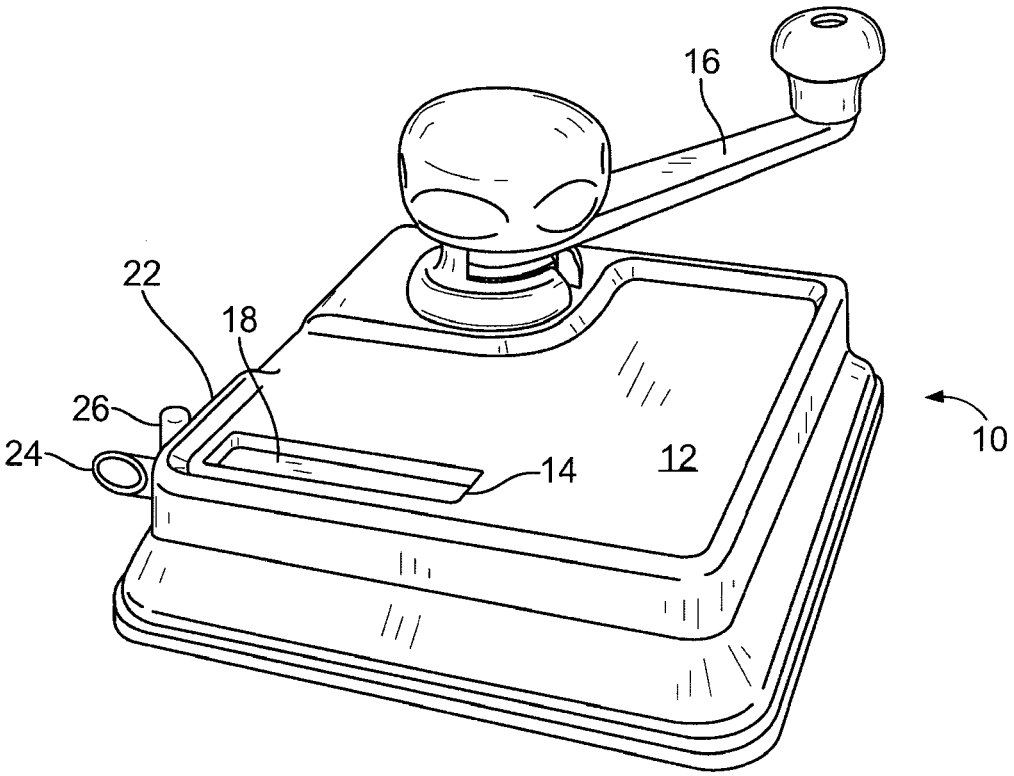
FIG. 1 is a perspective view of a manually operated cigarette-making machine fitted with a self-cleaning mechanism in accordance with an embodiment of the present invention.

Referring now to the figures, FIG. 1 is a perspective view of a manual cigarette-making machine 10, including a top 12, a compacting chamber access opening 14 and a crank handle 16. The self-cleaning cigarette tobacco compacting mechanism of the invention may be used with crank handle operated manual cigarette-making machines as described in detail herein or it may be used with semi-automatic and automatic cigarette-making machines respectively. Semi-automatic and automatic cigarette-making machines respectively use a handle for part of the cigarette-making process and an electric motor for the rest or use an electric motor for the entire process.

In the illustrated manual, a cigarette-making machine 10, a compacting chamber 18 lies below the access opening. Sidewall 22 of the machine, which lies adjacent one end of the compacting chamber, has a hollow nipple 24 in communication with the compacting chamber. Hollow cigarette tubes (not shown) may be slid onto the nipple and held in place by a spring loaded locking arm 26.

Cigarette-making machine 10 is operated by placing loose tobacco through compacting chamber access opening 14 and into compacting chamber 18. A hollow cigarette tube may be placed onto the nipple either before or after this step.

Figure 2A:
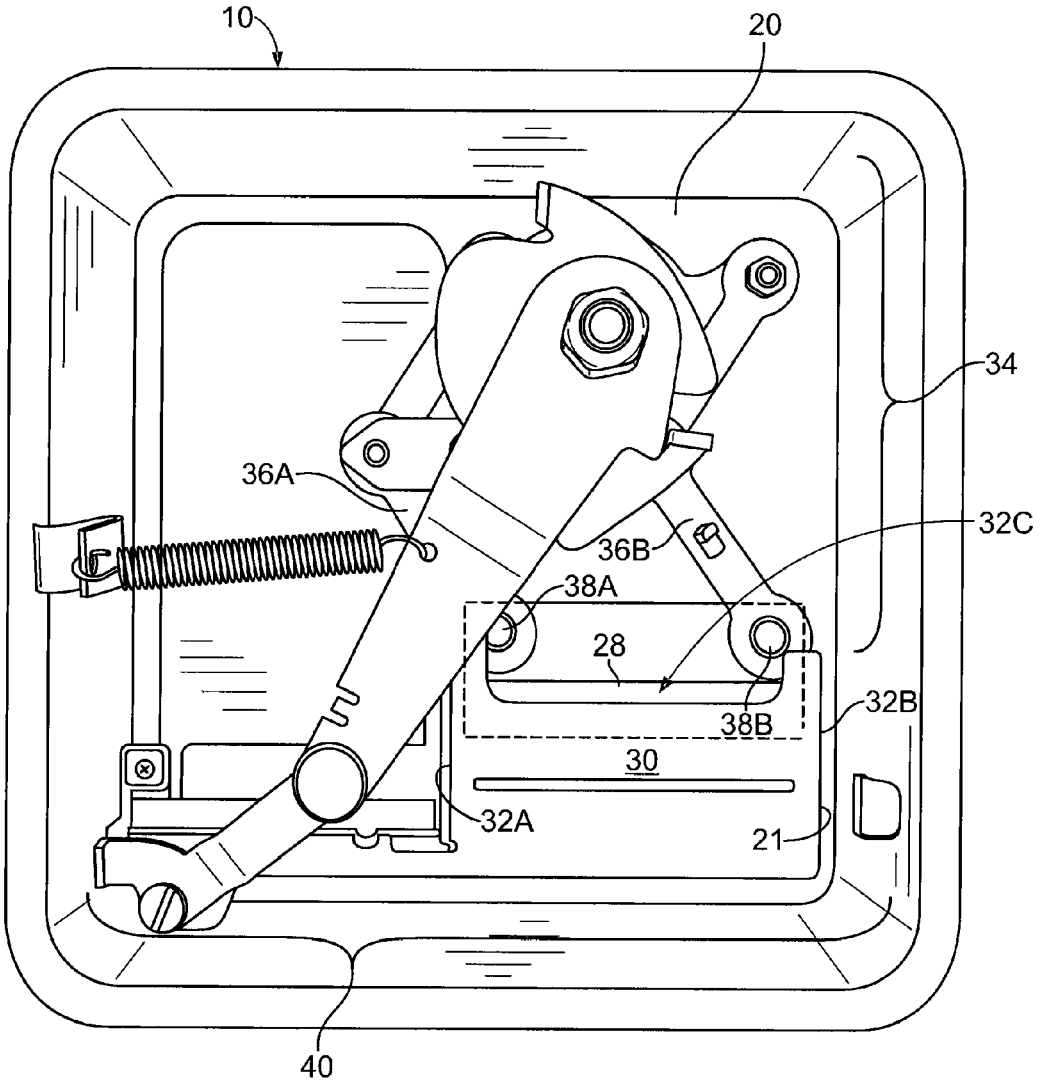
FIG. 2A is a bottom plan view of the cigarette-making machine of FIG. 1 in which the bottom cover has been removed to reveal the internal workings of the device.

FIG. 2A is a bottom view of the manual cigarette-making machine of FIG. 1 in which the bottom cover of the machine has been removed in order to reveal the working parts of the device. Compacting chamber 18 is a generally rectangular cuboid space lying between a top plate 21 attached to the back surface 20 of top 12 of the cigarette-making machine and a bottom plate 30 which is spaced from top plate 21*a* distance slightly greater than the thickness of the reciprocating compacting member in order to minimize friction between the compacting member and the top and bottom plates. The interstices between the reciprocating compacting member and top and bottom plates 21 and 30 are labeled respectively 42 and 44 in FIG. 4C.

Figure 2B:
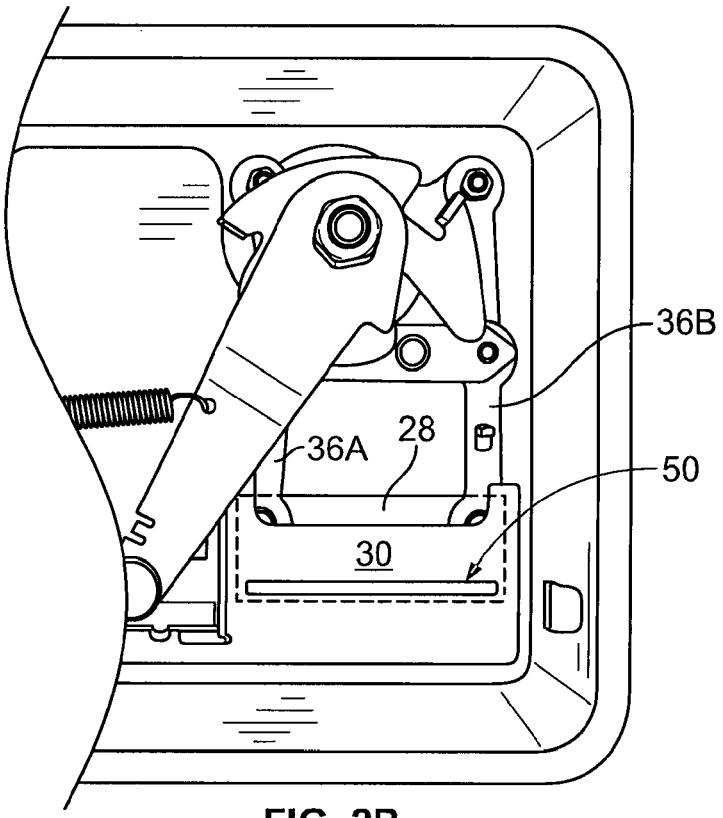
FIG. 2B is a partial bottom plan view of the cigarette-making machine of FIG. 1 illustrating the advancing tobacco compacting member of the device.

Side edges 32A and 30B of the compacting chamber are walled off to laterally confine the tobacco in the chamber and to help guide the up and down movement of the compacting member within the chamber. Top edge 32C of the compacting chamber is open to permit reciprocating compacting member 28 to move from its initial rest position adjacent the top of the compacting chamber shown in FIG. 2A down into the compacting chamber to compact the loose tobacco in the chamber into a rod-like shape as it comes to rest at the fully extended bottom-most end of its downward movement as shown in FIG. 2B. As the cigarette-making process is completed the reciprocating compacting member moves back up from the fully extended bottom-most position to return to its rest position.

The reciprocating up and down movement of the compacting member is controlled by a compacting drive mechanism 34 which is operated by crank handle 16 (FIG. 1). The compacting drive mechanism includes two arms 36A and 36B that are pivotally attached near the top of the compacting member at attachment points 38A and 38B and pivot as the compacting drive mechanism drives the reciprocating compacting member up and down in the compacting chamber.

Further details of exemplary manual cigarette-making machines can be seen, for example, in U.S. Pat. Nos. 4,215,705; 4,005,716; 3,886,952; and 3,202,156, the contents of which are incorporated by reference in their entireties. As can be seen in those patents, injection spoons are typically positioned adjacent to the bottom of the compacting chamber. When the compacting member is moved to its bottom-most position, it will compact the loose tobacco in the compacting chamber against the top surface of the injection spoon forming a compressed rod-like tobacco shape. The injection spoon (feature 58 in the embodiment of FIG. 4A) then moves across a compacting chamber like compacting chamber 18 of the illustrated embodiment of the present invention carrying the compressed rod-like shape from the compacting chamber through a hollow nipple like hollow nipple 24 of the illustrated embodiment of the present invention and into a hollow cigarette positioned on the nipple.

In the present embodiment, the lateral movement of the injection spoon is controlled by injection drive mechanism 40. Following the emplacement of the compressed tobacco in the hollow tube, the injection spoon is withdrawn from the now fully-filled cigarette tube and returned to its initial position within the compacting chamber and then the compacting member is retracted from the compacting chamber so that it returns to its initial position depicted in FIG. 2A. Both compacting drive mechanism 34 and injection drive mechanism 40 are activated and advanced by turning the crank handle from its initial position depicted in FIG. 1 to a fully rotated position and then returning the handle to its initial position. As noted earlier, in semi-automatic and automatic machines the action of the compacting drive mechanism and/or the injection drive mechanism may be motor driven.

Figure 3:
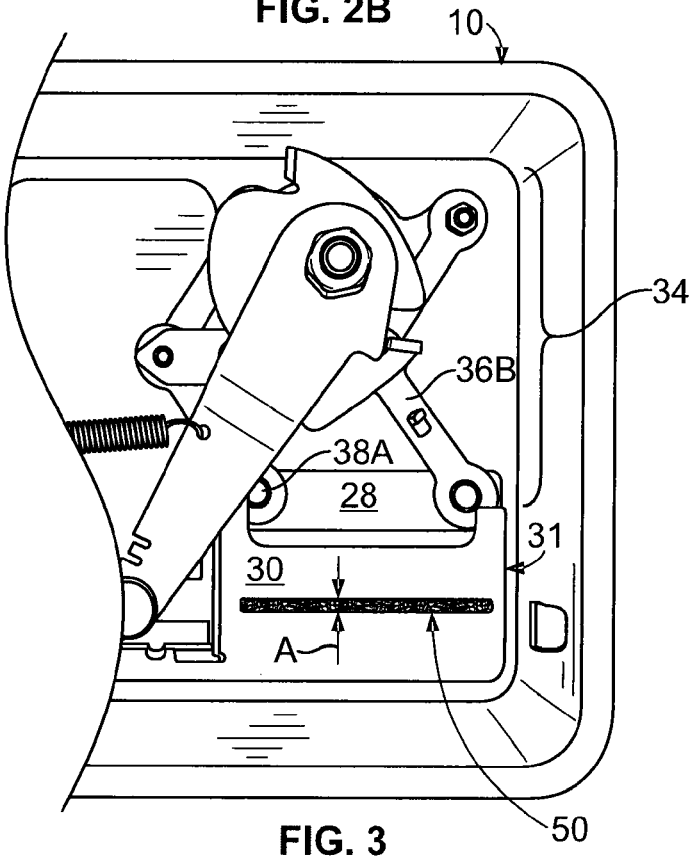
FIG. 3 is another (enlarged) partial bottom plan view of the cigarette-making machine of FIG. 1 in which tobacco is present in its compacting chamber and about to be compressed.

Turning now to FIG. 3, a self-cleaning generally horizontal slot 50 running across the bottom plate 30 can be seen. Preferably, slot 50 will be generally perpendicular to the back face 31 of the bottom plate (FIG. 4A) and of a length equal to or greater than the width of the compacting member. The height "A" of the slot may vary but it should be sufficiently narrow to ensure that little or no loose tobacco can escape from the slot as the compacting member moves downwardly in the compacting chamber to compact the loose tobacco against the top surface of the injection spoon. For example, where the compacting member is about 2.5 inches in width, slot 50 will be about 2.4 inches in width and about 0.13 inches in height. Also, the slot may be angled from the horizontal across the plate to present a longer self-cleaning slot.

Figure 4A:
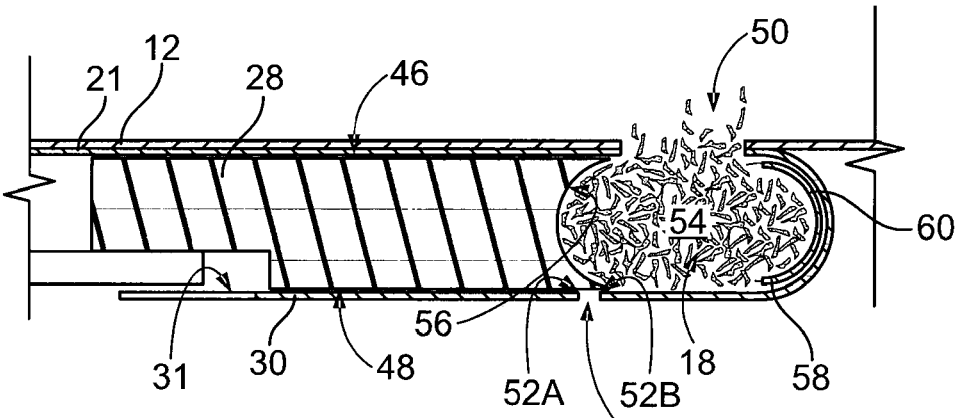
FIGS. 4A-4C are partial cut-away views of the compacting chamber of the cigarette-making machine of FIG. 1 showing the reciprocating compacting member advancing against loose tobacco in the chamber to compact the loose tobacco against an injection spoon in which the movement of the compacting member against a self-cleaning slot in the bottom plate of the chamber acts to control the build-up of tobacco fines and gummy tobacco materials.
Figure 4B:
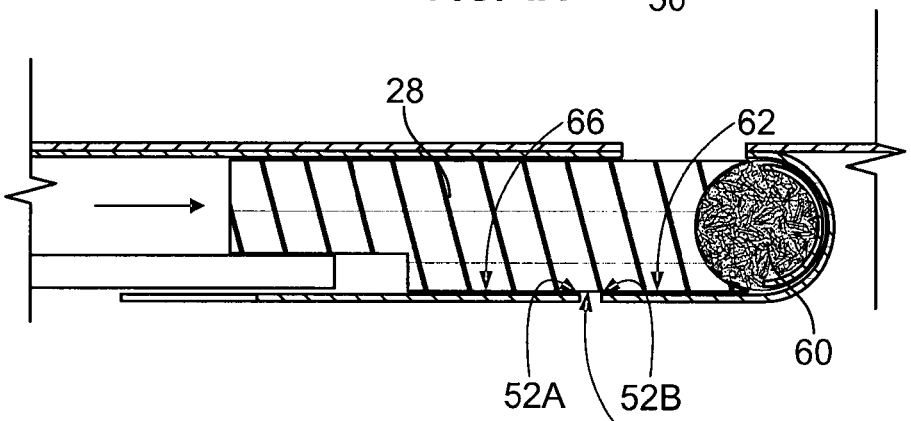
Figure 4C:
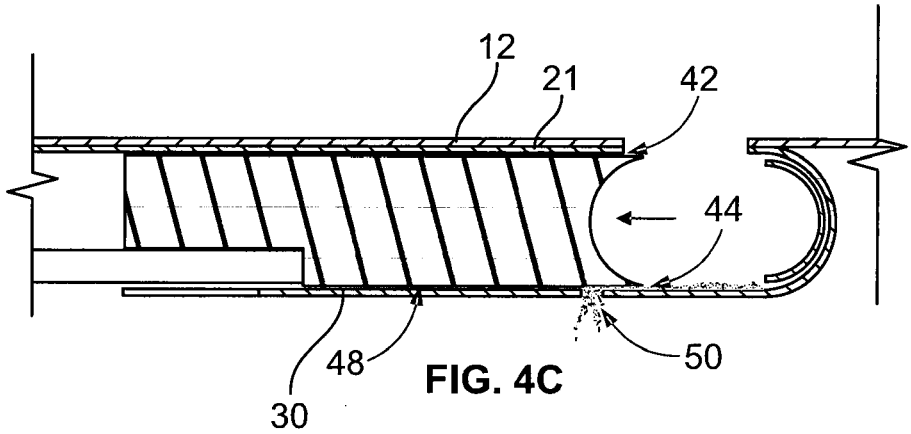

The function and operation of self-cleaning slot 50 may be best understood from FIGS. 4A-4C. These figures are enlarged partial cross-sectional views of the compacting chamber showing the compacting member advancing toward the injection spoon. In FIG. 4A, slot 50 is shown with internal edges 52A and 52B which preferably are sharp corners. In this figure, loose tobacco 54 is shown resident in compacting chamber 18 before reciprocating compacting member 28 begins to move downwardly within the chamber. As can be seen in this figure, the leading edge 56 of the compacting member is curved, and has a radius of curvature generally corresponding to the radius of curvature of the injection spoon 58.

In the configuration depicted in FIG. 4B, the compacting member has been moved downwardly in the chamber to its fully extended position to compact loose tobacco 54 into a compressed tobacco rod-like shape 60 between the curved leading edge 56 of the compacting member and the curved surface of the spoon. In the next stage of the operation of the cigarette-making machine, the cigarette spoon moves the compressed tobacco rod-like shape from the chamber into the hollow tube and the compacting member is retracted from the compacting chamber to the position depicted in FIG. 4C.

As noted earlier, cigarette tobacco naturally contains sugars and other components that are partially released as a gummy mixture when the tobacco is compressed in a compacting mechanism. Compressing the loose tobacco also breaks up portions of the tobacco to produce tobacco fines. Over time the tobacco fines as well as the gummy mixtures released during the compacting operation may accumulate in the interstices 42 and 44 between the outer surfaces 46 and 48 of the compacting member and the inner surfaces of top and bottom plates, particularly where there are variations intolerances between the thickness of the compacting member and the width of the compacting chamber. Self-cleaning slot 50, however, helps control this build-up.

Thus, as the reciprocating compacting member is retracted from the compacting chamber as shown in FIG. 4C, its outer surface moves across self-cleaning slot 50 causing the accumulated tobacco fines and gummy materials in interstice 44 to scraped-off against corner 52A of the slot so that these materials are ejected from the compacting chamber through the slot and fall to the bottom of the cigarette making machine where they will not cause any difficulties. Additional cigarette fines and gummy materials will be removed from interstice 44 as the compacting member moves from its initial position of FIG. 4A to its fully extended position of FIG. 4B past corner 52B in the same fashion. This further helps remove cigarette fines and gummy materials from the interface on each cycle of the operation of the machine. The self-cleaning slot thus help ensure long-term continued operation of the cigarette-making machine without undue friction due to build-up of fines and gummy materials in interstice 44.

Figure 5:
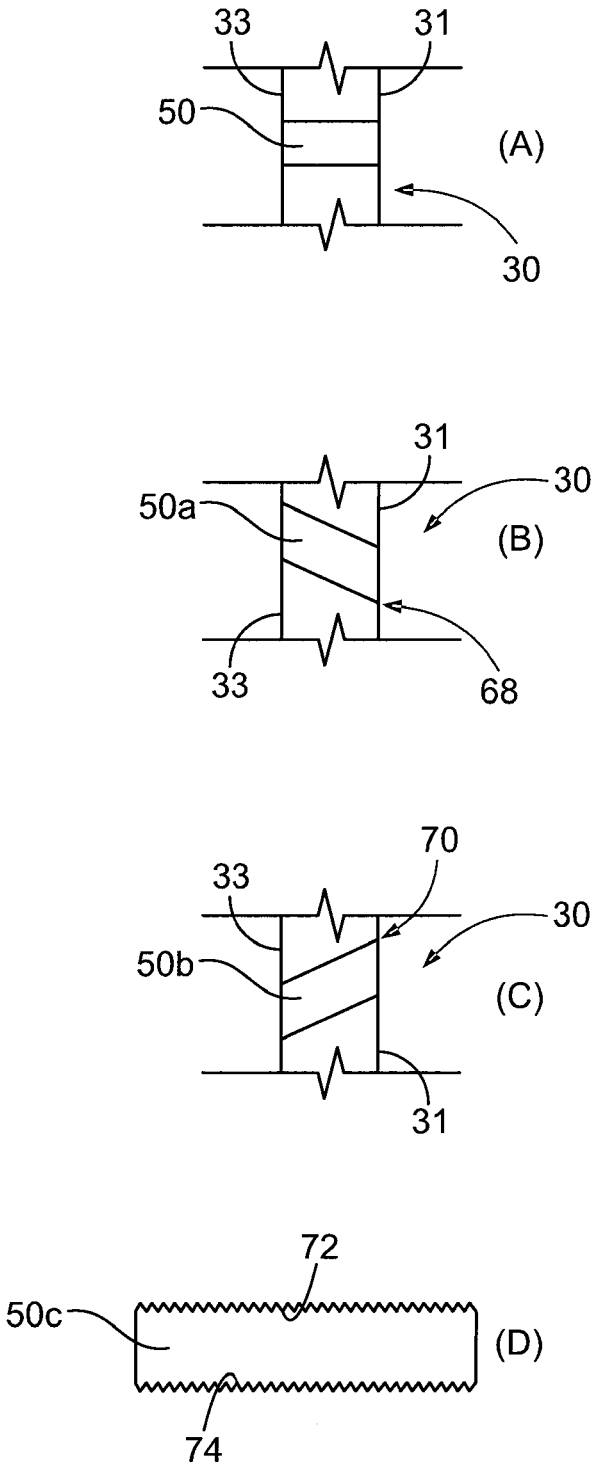
FIG. 5 is a series of partial cross-sectional and plan views of alternative configurations of self-cleaning slots in the bottom plate of the compacting chamber.

As illustrated in FIG. 5, slot 50 may extend perpendicularly across bottom plate 30 between its back face 31 and front face 33. In alternative embodiments, slots 50*a* and 50*b* are shown angled across the back plate to present sharp corners 68 and 70 where the slot engages the front surface of the reciprocating compacting member to help remove cigarette fines and gummy materials. Finally, in yet another embodiment a slot 50*c* may be provided in which the edges 72 and 74 of the slot are serrated to further facilitate the scraping and removal of cigarette fines and gummy materials. Such serrated edges may be used with either a perpendicular slot or with an angled slots 50*a* or 50*b*.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing embodiments of the invention (especially in the context of the following claims) are to be construed to cover both the singular and the plural, unless otherwise indicated herein or clearly contradicted by context. It should be understood that the illustrated embodiments are exemplary only, and should not be taken as limiting the scope of the invention. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

What is claimed is:

1. A self-cleaning cigarette tobacco compacting mechanism comprising:

a compacting chamber for receiving loose tobacco, the compacting chamber being positioned between top and bottom plates;

a compacting member mounted for reciprocal up and down motion between the plates, the compacting member having a bottom face that moves opposite the bottom plate; and a self-cleaning slot extending across the bottom plate positioned to engage the bottom face of the compacting member during its reciprocal up and down motion between the plates.

2. The self-cleaning cigarette tobacco compacting mechanism of claim 1 in which the self-cleaning slot includes sharp edges that engage the bottom face of the compacting member during its reciprocal up and down motion.

3. The self-cleaning cigarette tobacco compacting mechanism of claim 1 in which the self-cleaning slot is angled with respect to the horizontal across the bottom plate.

4. The self-cleaning cigarette tobacco compacting mechanism of claim 1 in which the self-cleaning slot extends perpendicularly across the bottom plate between its back and front faces.

5. The self-cleaning cigarette tobacco compacting mechanism of claim 1 in which the self-cleaning slot is angled between the back and front faces of the back plate.

6. The self-cleaning cigarette tobacco compacting mechanism of claim 1 in which the self-cleaning slot has serrated edges.

7. A cigarette-making machine comprising:

a housing including a compacting chamber for receiving loose tobacco positioned between top and bottom plates, a compacting member mounted for reciprocal up and down motion between the plates and opposite the bottom plate and a self-cleaning slot extending across the bottom plate positioned to engage the bottom face of the compacting member during its reciprocal motion between the plates;

an injection spoon for transporting compacted tobacco from the compacting chamber to a cigarette tube;

a compacting drive mechanism for operating the reciprocating compacting member; and an injection drive mechanism for operating the injection spoon, whereby the movement of the compacting in engagement with the bottom face of the compacting member scrapes the bottom face of the compacting member.

8. A cigarette-making machine as in claim 7 in which the machine is manually operated.

9. A cigarette-making machine as in claim 7 in which the machine is semi-automatic.

10. A cigarette-making machine as in claim 7 in which the machine is automatic.

11. A method of controlling the build-up of tobacco fines and gummy tobacco materials during the operation of cigarette-making machines using compacting apparatuses comprising:

providing a cigarette-making machine having a compacting chamber for receiving loose tobacco, the compacting chamber being positioned between top and bottom plates, a compacting member mounted for reciprocal up and down motion between the plates to compact the tobacco during which tobacco fines and gummy tobacco materials are released, the compacting member having a bottom face that moves opposite the bottom plate, and a self-cleaning slot extending across the bottom plate positioned to engage the bottom face of the compacting member during its reciprocal up and down motion between the plates, the compacting member having a bottom face that moves opposite the bottom plate;

placing tobacco in the compacting chamber and first advancing the compacting member down into the chamber to compact the tobacco and then retracting the compacting member; and scraping tobacco fines and gummy tobacco from the bottom face of the compacting member by moving it across the slot during its up and down motion.

* * * * *